United States Patent [19]

Schell

[11] Patent Number: 4,850,885

[45] Date of Patent: Jul. 25, 1989

[54] CONNECTOR MOUNTING SYSTEM

[75] Inventor: Mark S. Schell, Palantine, Ill.

[73] Assignee: E. I. Du Pont de Nemours and Company, Wilmington, Del.

[21] Appl. No.: 141,298

[22] Filed: Jan. 6, 1988

[51] Int. Cl.[4] ..... H01R 23/70

[52] U.S. Cl. ..... 439/79; 439/247

[58] Field of Search ..... 439/59–64, 439/79, 80, 246–252

[56] References Cited

U.S. PATENT DOCUMENTS

| | | | |
|---|---|---|---|
| 2,438,371 | 3/1948 | Marholz | 439/247 |
| 3,177,461 | 4/1965 | Hagan et al. | 439/633 |
| 3,673,545 | 6/1972 | Rundle | 439/248 |
| 4,470,100 | 9/1984 | Rebaudo et al. | 439/59 |
| 4,550,959 | 11/1985 | Grabbe et al. | 439/59 |
| 4,568,134 | 2/1986 | DiMondi | 439/64 |
| 4,636,019 | 1/1987 | Gillett et al. | 439/62 |

OTHER PUBLICATIONS

Catalog 86-A Du Pont Connector Systems, 3-1986.

*Primary Examiner*—Neil Abrams

[57] ABSTRACT

A connector mounting system allows a measure of lateral motion for a connector relative to its printed circuit board to accommodate any thermal expansion of the board. A mounting bracket is connected between the connector and the printed circuit board and includes openings through which guide members extend, the openings having a larger dimension in at least the lateral dimension of the printed circuit board than that of the corresponding dimension of the guide member to allow a measure of lateral clearance and movement of the bracket relative the guide member. Each guide member includes a flange portion that captures the bracket and constrains the bracket and the connector from torque-induced movement where the connectors are not mounted in the direct line of force for either inserting or extracting the connector. Electrical connection between the pins of the header and the circuit board is accomplished by flexible printed circuit that accommodates lateral motion of the connector relative to the printed circuit board.

18 Claims, 3 Drawing Sheets

CONNECTOR MOUNTING SYSTEM

BACKGROUND OF THE INVENTION

The present invention relates to mounting systems for mounting electrical connectors on a printed circuit board and, more particularly, to mounting system which allow a measure of relative movement between the connector and its printed circuit board.

One of the trends in the manufacture of electronic systems is to provide a backplane or 'motherboard' in which a number of 'daughterboards' are connected to form a complete system. This approach allows the system designer to place as many electrical devices and circuits as is practical on the daughterboards to maximize packaging efficiency and to shorten on-site service and repair time to that required to remove a defective daughterboard and replace it with a functional board. In larger systems, the size of each daughterboard can be quite large, for example, up to 24 inches (30 cm.) on a side. In such systems, a large number of circuit interconnects must oftentimes be effected with the motherboard. To this end, high pin count connectors systems have been developed which locate the respective pins and receptacles on relatively close centers, for example, 0.100 inches (2.54 mm.) in a multi-row matrix so that several hundred or more circuit connects are possible per connector.

In general, the use of a high pin count connector does not entail special mounting considerations. However, where the circuit board is relatively large and the number of circuit connects requires the use of two or more separate connectors along an edge of the printed circuit board, problems can be encountered under certain circumstances when mating the printed circuit board to its motherboard. For example, when the system is initially assembled, the daughterboards are typically at the same temperature as the motherboard and insertion of the daughterboards into their connectors on the motherboard is accomplished in the usual manner. Once the system is powered-on, the heat energy developed as a consequence of operation of the circuits causes the motherboard and the daughterboard to physically expand. Thus, where the daughterboard has two or more connectors along the edge that mates to the motherboard, the spacing between the connectors is increased somewhat. In general, this thermal expansion does not pose a problem or introduce undue physical stresses, since the various boards and connectors are made from the same materials or materials that are reasonably compatible with each other. However, if it is necessary to remove and replace a thermally hot daughterboard with replacement daughterboard that is at room temperature, the difference in physical size and connector spacing can greatly increase the insertion force, particularly where small pin center dimensions are used, and can unduly stress both the thermally hot motherboard and the room temperature daughterboard. While it is possible to allow the entire system to cool to room temperature before effecting board replacement, such a repair protocol is economically inefficient.

SUMMARY OF THE INVENTION

In view of the above, it is an object of the present invention, among others, to provide a connector mounting system for printed circuit boards by which dimensional changes in the printed circuit board can be readily accommodated.

It is another object of the present invention to provide a connector mounting system for edge mounted connectors used on printed circuit boards which will accommodate dimensional changes consequent to thermal expansion of a printed circuit board.

It is still another object of the present invention to provide a connector mounting system well suited for printed circuit boards having plural connectors mounted along one edge for mating with respective connectors mounted on another printed circuit board.

In view of these objects, and others, the present invention provides a connector mounting system which allows a measure of lateral clearance for a connector so that the connector is free to move laterally to accommodate dimensional changes caused by temperature changes. A mounting bracket is connected between the connector and the printed circuit board and includes openings through which guide members extend, the opening having a larger dimension in at least the lateral dimension of the printed circuit board than that of the corresponding dimension of the guide member to allow a measure of lateral clearance and movement of the bracket relative the guide member. The guide members include a flange portion that captures the bracket and constrains the bracket and the connector from torque-induced movement where the connectors are not mounted in the direct line of force for either inserting or extracting the connector. Electrical connection between the pins of the header and the circuit board is accomplished by flexible printed circuit wiring that accommodates lateral motion of the connector relative to the printed circuit board.

The present invention advantageously provides a connector mounting system in which the connector can move laterally relative to its printed circuit board to accommodate dimensional changes and is particularly well suited for use in a daughterboard type system in which the daughterboards can be conveniently installed in and removed from a motherboard.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
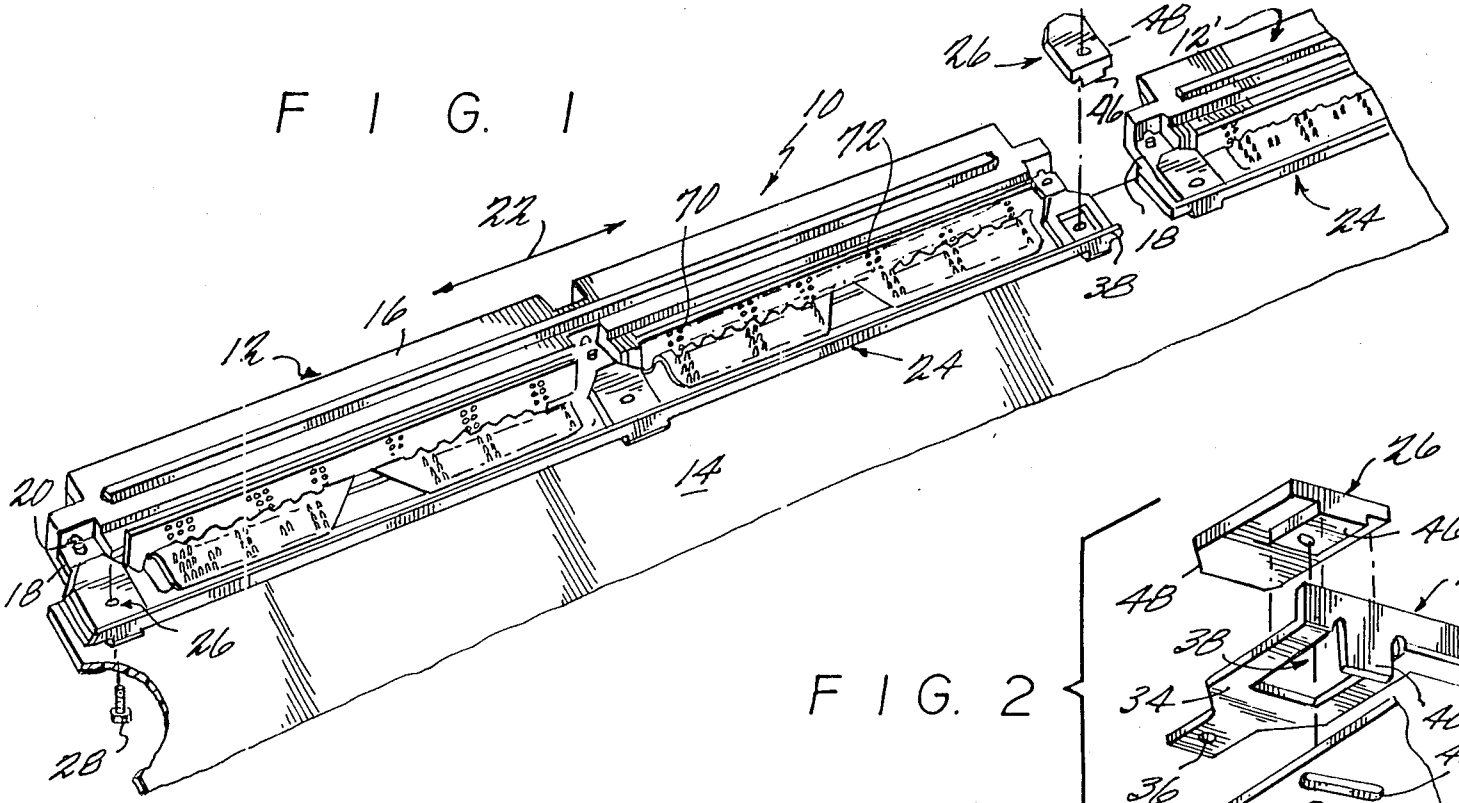
FIG. 1 is a perspective view of a connector mounted along the edge of an exemplary printed circuit board in accordance with the present invention.
Figure 7:
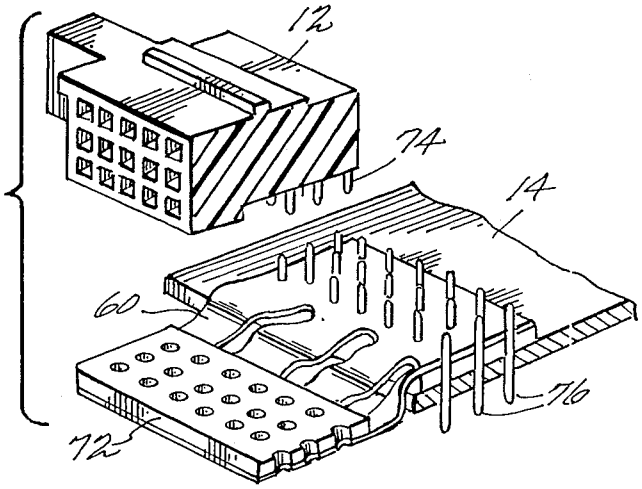
FIG. 7 is an exploded perspective view, in cross section, illustrating the interconnection between a printed circuit board and a connector in accordance with the present invention.

A connector mounting system 10 in accordance with the present invention is shown in FIG. 1 and, as shown, is designed to mount one or more connectors 12 and 12' (of which connector 12' is only partially shown) along one edge of a printed circuit board 14. In the preferred embodiment, the connectors 12 and 12' are high pin count connectors marketed under the HPC-XXXXX series designation by DuPont Connectors Systems of New Cumberland, PA 17070, these connectors available in lengths of up to sixteen inches with three or four rows of pins or receptacles mounted on 0.100 inch centers (2.54 mm.) with the terminal pins extending rearwardly as generally shown in FIG. 1 or downwardly as shown in the embodiment of FIG. 7. In FIG. 1, the connector 12 is a receptacle having three rows (as shown in FIG. 7) of openings into which the pins of a mating header (not shown) are inserted. The connectors 12 shown in FIG. 1 each include a molded body 16 with mounting surfaces 18 formed at each end and at an intermediate position. Each mounting surface 18 includes a through bore (not specifically shown) through which a fastener, such as threaded fastener 20, can be used to mount the connectors 12 and 12' to the printed circuit board 14 in accordance with the present invention and as described below.

The connector mounting system 10 is well suited for mounting elongated connectors having respective long axes co-aligned along an edge of a relatively large printed circuit board 14 so as to accommodate thermal expansion of the printed circuit board 14 and allow a measure of relative movement between the connector 12 and the printed circuit board in a direction co-aligned with the long axis of the connector 12. As shown in the two-connector application of FIG. 1, the connectors 12 and 12' are mounted in a spaced apart relationship on one edge of the printed circuit board 14. When the temperature of the printed circuit board 14 is raised, the printed circuit board 14 will expand widthwise in the lateral direction, as indicated by the bi-directional arrow 22, to increase the spacing between the connectors 12 and 12'. In general, the nominal insertion force for each pin/receptacle pair is about 42 grams and the nominal withdrawal force is about 11 grams with the total insertion or withdrawal force per connector 12 dependant upon the total number of pin/receptacle connects. In the embodiment illustrated, the connectors 12 each have 213 interconnects for a total insertion force of about 13 kg per connector and a total withdrawal force of about 3.4 kg. When the printed circuit board 14 expands laterally because of an elevated operating temperature, the as-designed spacing between the two connectors 12 and 12' increases as a function of the width of the printed circuit board 14 and effects small but discernible increases in the spacing between the receptacles on one connector relative to those on the other connector. Where the printed circuit board 14 and the mating board, e.g., a backplane, are at the same temperature, the dimensional expansion does not markedly increase the insertion or withdrawal force or induce stresses within the printed circuit board 14. Where it is necessary to replace a thermally hot printed circuit board 14 with a replacement board that is at a lower ambient temperature, the dimensional mis-match will markedly increase the insertion force as well as introduce stresses in the connectors 12 and 12' which stresses will remain until the replacement board achieves thermal equilibrium. In accordance with the present invention, the connectors 12 and 12' are mounted for limited lateral movement in a direction generally co-aligned with the long axis of the connector so that alignment differences can be readily accommodated to eliminate the above problem.

Figure 2:
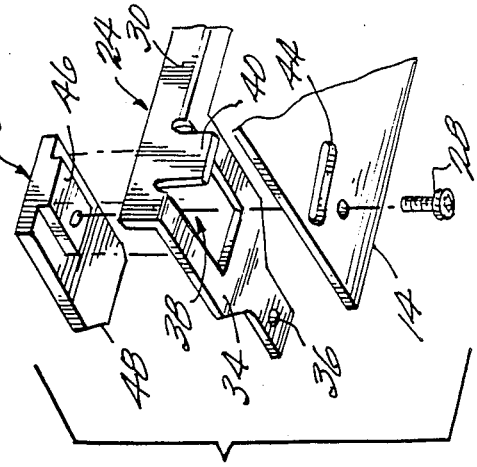
FIG. 2 is an exploded perspective view of a portion of the mounting system of FIG. 1.
Figure 3:
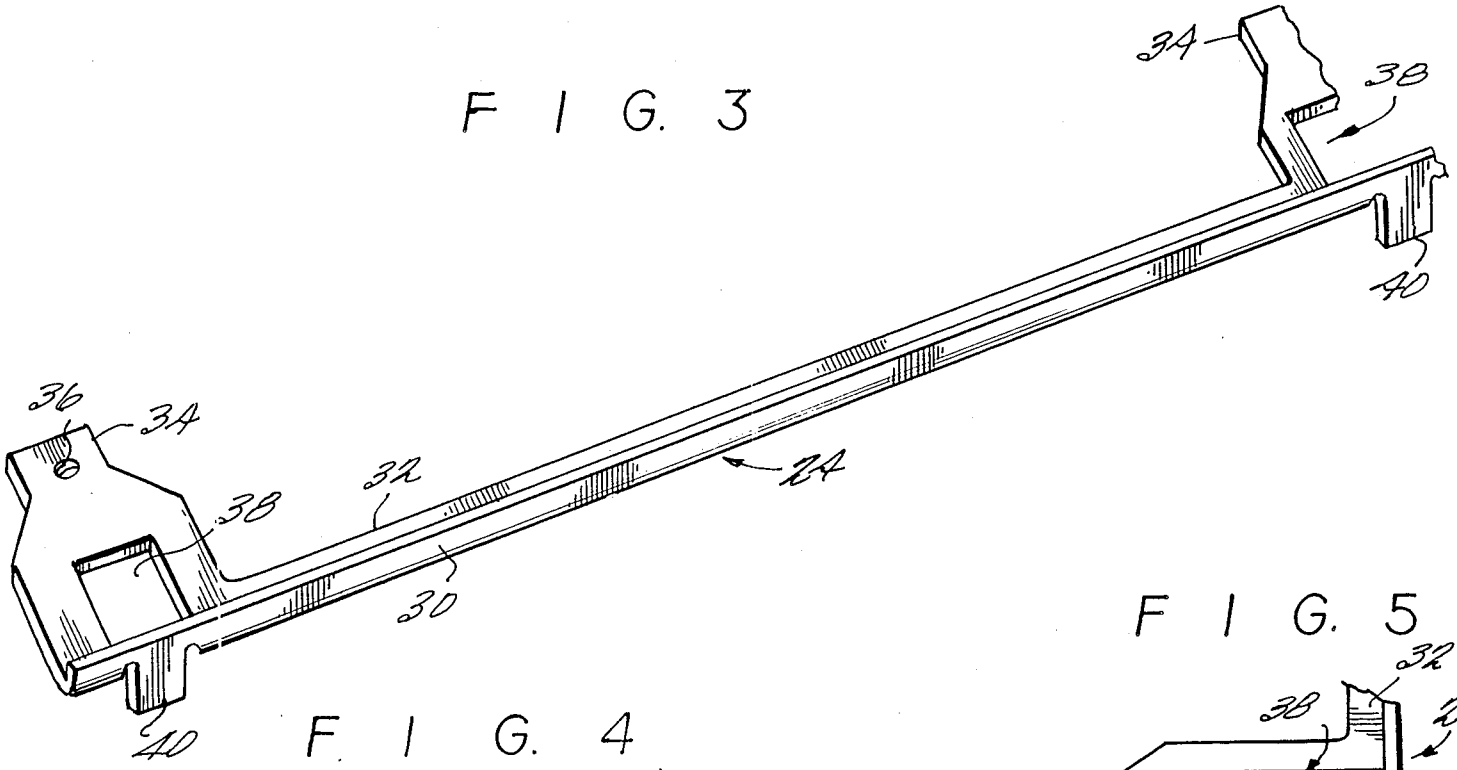
FIG. 3 is a perspective view of a portion of a mounting bracket shown in FIGS. 1 and 2.

As shown in FIG. 2, the connectors 12 and 12' are coupled to the printed circuit board 14 by a bracket 24, a guide member 26, and a fastener 28, such as the illustrated screw. As shown in FIGS. 2 and 3, the bracket 24 is formed from intersecting wall sections and includes a first, upstanding wall section 30 formed at a generally right angle with a second wall section 32 that is generally aligned in a parallel relationship with the adjacent surface of the printed circuit board 14. Mounting flanges 34 extend from the wall section 32 in positions that correspond with the mounting surfaces 18 of the connectors 12 and 12' and to which the connectors 12 and 12' are secured with the fastener 20 extending through a bore 36 adjacent the remote end of each mounting flange 34. The remote end portion of each mounting flange 34 is shaped as appropriate to engage the corresponding mounting surface 18 of its connector 12. Each mounting flange 34 is formed with a pilot opening 38 which receives the guide member 26 as described below and is shaped as a rectangle in the preferred embodiment. A locating tab 40 depends from the upstanding wall section 30 and is received within a slot 44 formed in the printed circuit board 14. The bracket 24 is preferably formed from a pressed or stamped aluminum sheet stock.

Figure 5:
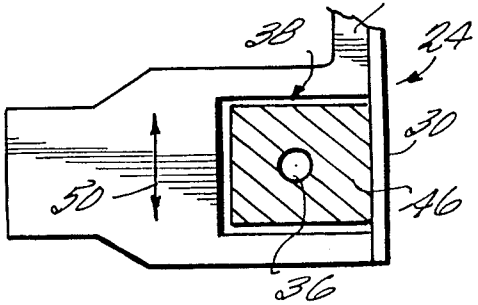
FIG. 5 is a plan view of a guide member, in partial cross section, taken along line 5—5 of FIG. 4.
Figure 4:
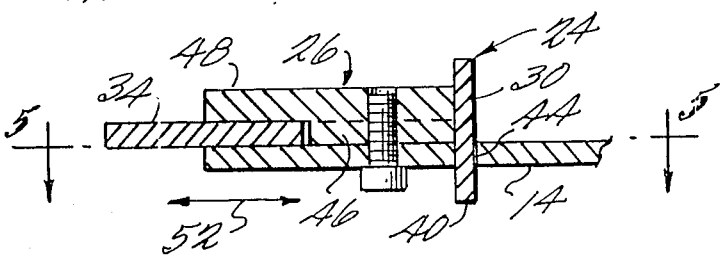
FIG. 4 is a side elevational view of, in cross section, of a portion of the connector mounting system.

The guide member 26, as shown in FIG. 2, is preferably formed as a unitary component and includes a pilot block 46 which, in the preferred embodiment is configured as a parellelepiped, and a guide flange 48 which extends laterally outward and forwardly from the pilot block 46. The pilot block 46, as shown in the cross-sectional view of FIG. 5, has a lateral width dimension somewhat less that the lateral width dimension of the pilot opening 38 to form a preselected clearance space in the lateral direction between the sides of the pilot block 46 and the sides of the pilot opening 38. In the preferred embodiment, a clearance dimension of between 0.020 and 0.040 inches (0.5 mm. and 0.10 mm., respectively) will allow bi-directional movement of the connector 12 along its long axis as indicated by the arrow 50 to accommodate the expected range of lateral width expansion consequent to thermal heating as well as accommodate cumulative tolerances. As shown in FIG. 4, the height of the pilot block 46 from its bottom surface, which contacts the printed circuit board 14, and the underside of the guide flange 48 is somewhat greater than the thickness dimension of the mounting flange 34 so that the guide member 26 effectively captures its mounting flange 34 between the printed circuit board 14 and the underside of the guide flange 48 so that the bracket 24 is free to move laterally to the extent permitted by the predetermined clearance dimension describe above.

The bracket 24 is constrained for controlled movement in the fore and aft direction, as represented by the arrow 52 in FIG. 4, by either the length of the pilot block 46 in the fore and aft direction or, more preferably, by the tab 40 which, as shown in FIGS. 2 and 4, extends through the slot 44 formed in the printed circuit board 14. In the preferred embodiment, the slot 44 and that of the tab 40 have a clearance dimension (that is, the difference between the lateral dimension of the slot 44 and the tab 40) that is at least as large as the aforedescribed clearance between the pilot opening 38 and its pilot block 46 so that the tab 40 does not impede movement of the bracket 24 and its attached connector 24 in the lateral direction. The clearance dimension between the tab 40 in the fore and aft direction, as represented by the arrow 52 in FIG. 4, is controlled in accordance with the specific design application. In the preferred embodiment, the dimension of the slot 44 in the fore and aft direction is controlled to either provide a line-to-line slip fit or a small clearance fit so the connectors 12 and 12' are effectively constrained from motion in the fore and aft direction as the printed circuit board 14 is either withdrawn or inserted into its cooperating header. If desired and depending upon the particular application, a larger clearance dimension may be provided to allow limited fore and aft motion of the connectors 12 and 12'.

Since the connectors 12 and 12' are not mounted directly to the printed circuit board 14, the tabs 40 and their restraining slots 44 are effective in providing relatively broad thrust-bearing surfaces to accommodate the insertion and withdrawal forces involved in removing and replacing a printed circuit board 14. More specifically, each tab 40 presents a relatively large surface area that bears against the rearward side of its slot 44 during insertion and a corresponding surface area on its opposite side that bears against the forward side of the slot 44 during withdrawal to provide a mounting arrangement in which the printed circuit board 14 is not subjected to unduly large local compressive forces during insertion and withdrawal.

When the printed circuit board 14 is inserted or withdrawn, a force is applied in the fore or aft direction in the plane of the printed circuit board 14. Since the connectors 12 and 12' are not mounted directly in the line of this force, a torque is developed that tends to rotate the connectors 12 and 12' about a laterally directed axis. The guide flanges 48, by extending over and capturing the mounting flanges 34, effectively limits the effect of the torque developed during insertion or withdrawal of the printed circuit board 14.

Figure 6:
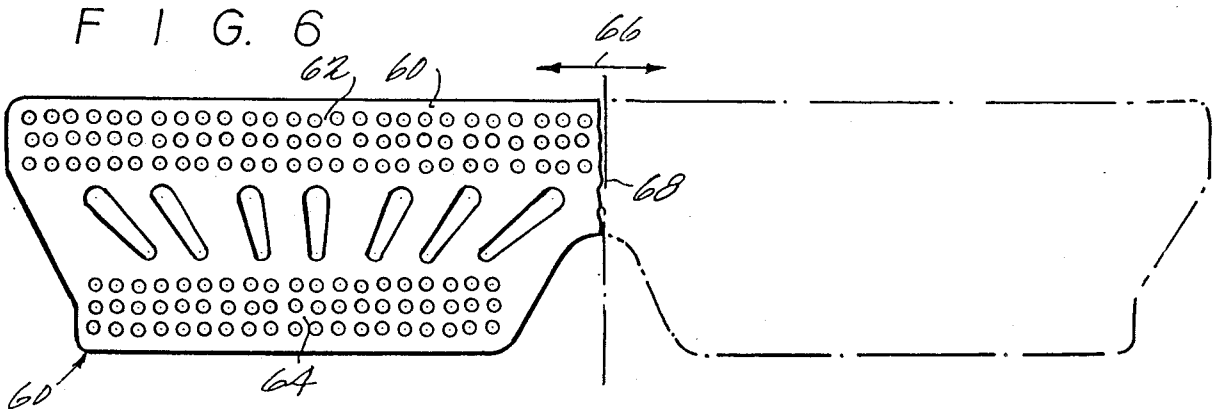
FIG. 6 is a flat development view of a flexible circuit for interconnecting a printed circuit board with a connector mounted in accordance with the present invention.

The connectors 12 and 12' are electrically coupled to the printed circuit board 14 using a flex circuit 60 shown flat development and in both solid and dotted line illustration in FIG. 6 and shown in an exemplary installed configuration in FIG. 7. The flex circuit 60 is fabricated in a conventional manner with a Kapton cover and substrate layer with conductive traces (not shown in FIG. 6) extending between a pin-connect field 62 for the pins extending from the rear side of the connectors 12 and 12' and a corresponding pin-connect field 64 for connection to pins on the printed circuit board 14. Since the flex circuit 60 will be subjected to relative lateral motion, as indicated by the bidirectional arrow 66 in FIG. 6, a series of slot-like openings or cutouts 68 are provided in the web portion of the flex circuit 60 between the pin connect fields 62 and 64 to allow the lateral motion without buckling or unduly stressing the material. As shown, the cutouts 68 are generally sector-shaped and defined by semi-circular patterns at their opposite ends, the radius of the semi-circular pattern adjacent the pin-connect field 62 being larger than that adjacent the pin-connect field 64.

The flex circuit 60 is installed by connecting the pin field 64 to a corresponding array of terminal pins 70 (FIGS. 1 and 7) mounted in and extending upwardly from the surface of the printed circuit board 14. In the installation of FIG. 1, the connector terminal pins extend rearwardly of the connectors 12 and 12' to intercept the pin field 62 and, if desired, a spacer substrate 72 can be interposed between the flex circuit 60 and the rear side of each of the connectors 12 and 12'. The spacer substrate 72 can be fabricated, for example, from a phenolic or glass-filled resin sheet stock. In addition to the mounting arrangement presented in FIG. 1, a connector 12 of the type shown in FIG. 7 may be used. As shown, the terminal pins 74 extend downwardly from the body of the connector 12 and through appropriate apertures in the spacer substrate 72 to effect engagement with the flex circuit 60. Electrical connection between the various terminal pins and their corresponding contact pads (not shown) on the flex circuit 60 are effected by soldering in the conventional manner. The pin field 64 is connected in the usual manner to terminal pins 76 staked to or otherwise mounted on the printed circuit board 14.

The present invention advantageously provides a connector mounting system in which the connector can move laterally relative to its printed circuit board to accommodate dimensional changes and is particularly well suited for use in a daughterboard type system in which the daughterboards can be conveniently installed in and removed from a motherboard.

Thus it will be appreciated from the above that as a result of the present invention, a connector mounting system is provided by which the principal objectives, among others, are completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims and their legal equivalent.

What is claimed is:

1. A mounting system for mounting an elongated electrical connector to a substrate for relative movement therebetween in a direction co-aligned with the long axis of the connector comprising:

a bracket member for attachment to said electrical connector and having at least first and second pilot openings formed therein;

a guide member associated with each of said pilot openings for attachment to a substrate and having a pilot portion thereof extending through the respective pilot opening, each of said pilot portions and its respective pilot opening having respective dimensions in a direction co-aligned with a long axis of the connector and dimensioned to allow relative movement between the connector and the substrate in a direction co-aligned with the long axis of the connector, the long axis of the connector being substantially perpendicular to the direction of coupling of the connector with a mating connector; and means for retaining said bracket member between said guide member and the substrate.

2. The mounting system of claim 1, wherein said retaining means constrains said bracket member from movement in any direction other than that in a direction co-aligned with the long axis of the connector.

3. The mounting system of claim 1, wherein said retaining means further comprises a flange member connected to said pilot portion for constraining said bracket between said flange member and said substrate for movement in a direction co-aligned with the long axis of the connector.

4. The mounting system of claim 1, further comprising:

means for interengaging said bracket and the substrate.

5. The mounting system of claim 4, wherein said interengaging means comprises a tab connected to said bracket means for placement in a tab-receiving opening formed in the substrate.

6. A mounting system for mounting an elongated electrical connector to a substrate for relative movement therebetween in a direction co-aligned with the long axis of the connector, comprising:

a bracket member for attachment to said electrical connector and having at least a first wall portion having at least first and second pilot openings formed therein;

a guide member associated with each of said pilot openings for attachment to a substrate and having a pilot portion thereof extending through the respective pilot opening, each of said pilot portions and its respective pilot opening having respective dimensions in a direction co-aligned with a long axis of the connector and dimensioned to allow relative movement between the connector and the substrate in a direction co-aligned with the long axis of the connector, the long axis of the connector being substantially perpendicular to the direction of coupling of the connector with a mating connector; and means for retaining said first wall portion between the guide member and the substrate.

7. The mounting system of claim 6, wherein said retaining means constrains said bracket member from movement in any direction other than that a direction co-aligned with the long axis of the connector.

8. The mounting system of claim 6, wherein said retaining means further comprises a flange member connected to said pilot portion for constraining said first wall portion between said flange member and the substrate for movement in a direction co-aligned with the long axis of the connector.

9. The mounting system of claim 6, wherein said pilot openings are rectangular in form and said pilot portion is formed as a parallelepiped having first and second dimensions, a one of said first and second dimensions in a direction co-aligned with the long axis of the connector being less than that of the corresponding dimension of its pilot opening.

10. The mounting system of claim 6, further comprising:

means for interengaging said bracket and the substrate.

11. The mounting system of claim 10, wherein said interengaging means comprises a tab connected to said bracket means for placement in a tab-receiving opening formed in the substrate.

12. The mounting system of claim 11, wherein said bracket further comprises:

a second wall portion formed at a selected angle relative to said first wall portion, said tab formed as an extension of said second wall portion.

13. A connector mounting system for mounting a connector along an edge of a printed circuit board to allow relative movement of the connector in a direction co-aligned with the edge of the printed circuit board, comprising:

an electrical connector having a long axis and electrical terminal means for effecting electrical connection thereto, the long axis of the connector being substantially perpendicular to the direction of coupling of the connector with a mating connector;

a circuit board substrate having electrical terminal means for connection to the electrical terminal means of said electrical connector;

bracket means for attachment to said electrical connector and having at least first pilot opening formed therein;

guide means associated with the pilot opening for attachment to said substrate and having a pilot portion thereof extending through the pilot opening, the pilot portion and the pilot opening having respective dimensions in a direction co-aligned with a long axis of said connector and dimensioned to allow relative movement between said connector and said substrate in a direction co-aligned with the long axis of said connector;

means for retaining said bracket means between the guide member and said substrate; and flex circuit means for effecting electrical connection between the respective electrical terminal means of said electrical connector and said substrate.

14. The mounting system of claim 13, wherein said retaining means constrains said bracket means from movement in any direction other than a direction co-aligned with the long axis of said connector.

15. The mounting system of claim 14, wherein said retaining means further comprises a flange member connected to said pilot portion for constraining said bracket means between said flange member and said substrate for movement in a direction co-aligned with the long axis of said connector.

16. The mounting system of claim 15, wherein said pilot opening are rectangular in form and said pilot portion is formed as a parallelepiped having first and second dimensions, a one of said first and second dimensions in a direction co-aligned with the long axis of said connector less than that of the corresponding dimension of the pilot opening.

17. The mounting system of claim 16, further comprising:

means for interengaging said bracket means and said substrate.

18. The mounting system of claim 17, wherein said interengaging means comprises a tab connected to said bracket means for placement in a tab-receiving opening formed in the substrate.

* * * * *